US005375343A

United States Patent [19]

Egger

[11] Patent Number: 5,375,343

[45] Date of Patent: Dec. 27, 1994

[54] EVAPORATOR FOR DRYING SLUDGES

[75] Inventor: Josef Egger, Oberengstringen, Switzerland

[73] Assignee: Buss AG, Basel, Switzerland

[21] Appl. No.: 101,245

[22] Filed: Aug. 2, 1993

[30] Foreign Application Priority Data

Dec. 2, 1991 [DE] Germany ..... 9114967

[51] Int. Cl.[5] ..... F26B 11/12

[52] U.S. Cl. ..... 34/181; 34/387; 34/386; 34/182

[58] Field of Search ..... 34/132, 133, 134, 179, 34/181, 182, 183, 380, 384, 386, 387

[56] References Cited

U.S. PATENT DOCUMENTS 3,292,870 12/1966 Lang .
3,313,034 4/1967 Meyer ..... 34/58

FOREIGN PATENT DOCUMENTS 1271497 8/1961 France .
102230 5/1898 Germany .
2306856 8/1974 Germany .
662303 12/1951 United Kingdom .
1158191 7/1969 United Kingdom .

*Primary Examiner*—Denise L. Gromada
*Attorney, Agent, or Firm*—Spencer, Frank & Schneider

[57] ABSTRACT

An evaporation device for drying sludges includes a heatable, hollow cylindrical, approximately horizontally oriented evaporator provided at one end with a product inlet and at the other end with a product outlet while in its product-charged interior an essentially radially oriented, externally driven rotor is disposed which is equipped with vanes that extend essentially over the length of the evaporator. At least in the region upstream of the product outlet, the walls of the interior are provided with at least one cutting zone that extends essentially in the longitudinal direction of the interior and interrupts the circular outline of the cross section of the interior.

11 Claims, 2 Drawing Sheets

FIG. 2
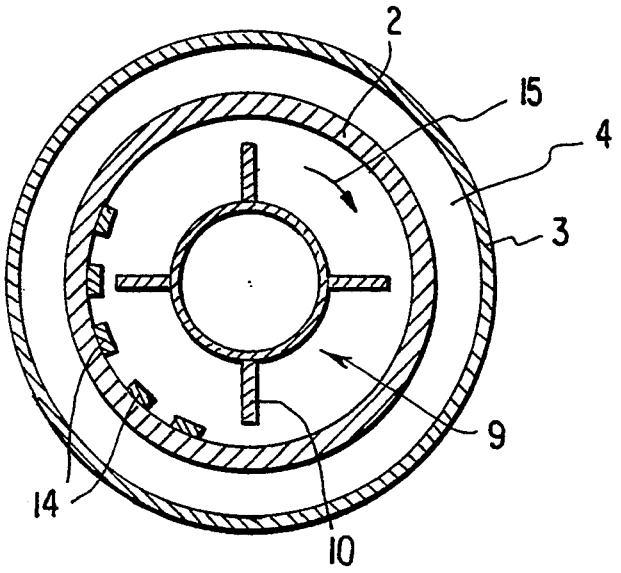
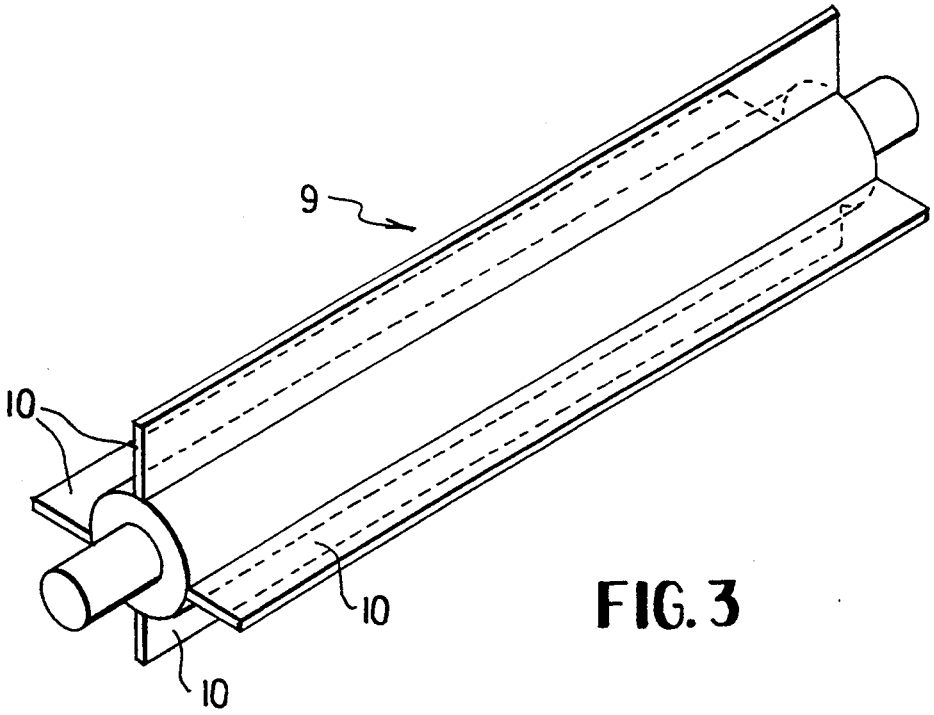
FIG. 3

EVAPORATOR FOR DRYING SLUDGES

CROSS REFERENCE TO RELATED APPLICATION

This application is a continuation-in-part of pending PCT Application EP92/01947, filed Aug. 25, 1992, which claims the priority of application Ser. No. G 91/14,967.3, filed Dec. 2, 1991, in the Federal Republic of Germany, the subject matter of both applications being incorporated herein by reference.

BACKGROUND OF THE INVENTION

The present invention relates to an evaporation device for drying sludges, the device including a heatable, hollow cylindrical evaporator that is oriented approximately horizontally and is provided at one end with a product inlet and at the other end with a product outlet. In the interior of the evaporator where it is charged with the product there is disposed an externally driven rotor which is equipped with essentially radially oriented vanes that extend essentially over the length of the evaporator.

Such an evaporation device has been used for many years to dry wet products, particularly sludges from waste water systems. The vanes of the internally rotating rotor which extend essentially over the length of the evaporator and whose edges end at a small distance from the interior wall of the evaporator cause the sludges to be deposited on the heated interior wall of the evaporator in the form of a thin product film, with the rotor vanes continuously transporting the product through the evaporator and discharging it at the product outlet in the form of an at least partially dry granulate.

In this connection, it has been found to be necessary to make the interior surface of the evaporator smooth and cylindrical throughout in order to obtain a high heat transfer rate to the product or sludge film. However, with many such sludges there exists the problem during drying that, with decreasing water content, the material to be dried, which is introduced at the product inlet as a pumpable product, goes through a viscous intermediate phase which leads to the formation of large lumps. In certain regions of the "viscous" phase of the sludge to be dried, there will initially be product baking onto the vane edges which prevents the formation of a product film because the interior surface is "wiped" in this region and the drying process is interfered with. From time to time the baked product comes loose in coarse agglomerates. Although these coarse agglomerates are substantially broken up again by the rapidly rotating rotor vanes, they result in a large percentage of fine grained material or dust. Moreover, the heat transfer to a product to be dried, which is present in the form of coarse lumps, is considerably reduced by their small contact surface toward the heated interior wall. The resulting coarse lumps have such a configuration that they have a relatively thin, dry outer surface which encloses a still relatively wet product quantity. If such lumps reach the product outlet, their breaking open may cause sticking, baked-on product, etc. in subsequently connected devices.

SUMMARY OF THE INVENTION

It is now an object of the present invention to configure an evaporator of the above-mentioned type in such a way that the formation of lumps in the critical zones is prevented and the end product is the most uniform possible granulate.

This is accomplished according to the invention in that the walls of the interior, at least in the region upstream of the product outlet, are provided with at least one cutting zone that extends essentially in the longitudinal direction of the interior and interrupts the circular outline of the cross section of the interior. Surprisingly it was found that the development of coarse lumps is already avoided if the smooth circular and cylindrical outline of the inner walls is interrupted beginning approximately in the region of the viscous phase. Thus developing large lumps whose thickness is greater than the size of the narrow gap between the edges of the rotor vanes and the inner walls of the evaporator are retained and broken up by the vane edges. In this way it is ensured that granulates can be produced only in the grain size given by the gap between the vane edge and the cylindrical portion of the interior walls of the evaporator. At the same time, in spite of the interruption of the smooth inner wall in the cutting zone, the formation of a uniform layer on the interior surface serving as the heat transfer surface and thus a high heat transfer density is ensured. Instead of coarse lumps, an almost uniform granulate results which contains few fines.

In one embodiment of the invention the cutting zone is formed by at least one recess, particularly a trough-shaped recess, in the interior wall. The cutting zone formed by the trough-shaped recess in the inner wall, which leads to an enlargement of the distance between the outer edge of the vane and the cylinder wall, results in baked-on portions formed in the edge region of the vanes breaking off early and being jammed in, as downward rolling clumps having a larger diameter than the normal gap distance between vane edge and cylindrical wall, and then being broken up. The continuously resupplied sludge which, due to the evaporation, is already viscous, is transported further as a substantially closed product film and then as a granulate to the discharge end. The recess may here be formed as a continuous trough or groove or in the form of several successive individual recesses that are set back from one another in the longitudinal direction of the interior.

In another embodiment of the invention, the cutting zone is formed by at least one projection, particularly a web-shaped projection, of the interior wall. With such a web-shaped projection, the normal gap between the vane edge and the interior wall of the evaporator becomes slightly smaller. Here again, a larger lump rolling off in the region of the vane edge is held by the projection so that the vane edge is able to break up the lump.

It was now a surprising development that, with a cutting zone formed by recesses or by projections, neither the recess forming the cutting zone nor the region upstream or downstream of a web-shaped cutting zone is clogged by product. Presumably the reason for this is that, in addition to the forces acting on the product in the circumferential direction by way of the vanes, additional forces exist which act on the product in the direction of its passage and push the product in the longitudinal direction also in the region of the cutting zone so that deposits and/or baked-on portions are avoided.

In a preferred embodiment of the invention, a plurality of spaced, approximately parallel linear cutting zones are provided. In this connection it has been found to be particularly favorable to have a configuration in which the cutting zones, with respect to the direction of rotation of the rotor, are disposed at least in the wall region swept by the upwardly rotating vanes. In order to ensure that the product to be dried continues to be transported to the product outlet on the heated interior walls of the evaporator in only a thin layer, the "height" of the cutting zones is here only a few millimeters.

BRIEF DESCRIPTION OF THE DRAWINGS

The invention will now be described in greater detail for one embodiment thereof that is illustrated schematically in the drawing figures, in which:

FIG. 2 is a cross-sectional view seen along line II–II of FIG. 1, but including the rotor; and FIG. 3 depicts a rotor.

DETAILED DESCRIPTION OF THE PREFERRED EMBODIMENT

Figure 1:
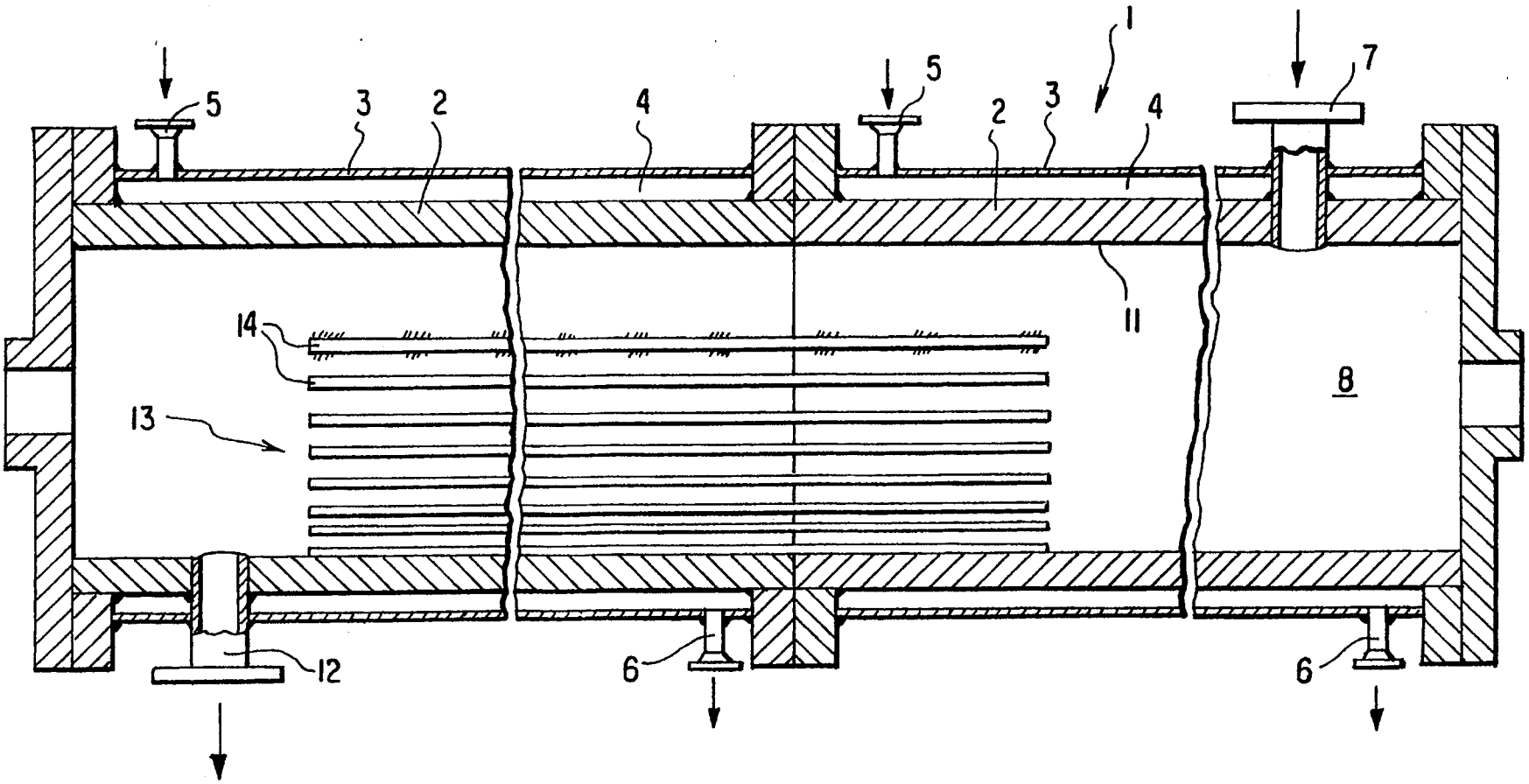
FIG. 1 is a longitudinal sectional view of an evaporator, but without rotor.

The longitudinal sectional view of FIG. 1 shows the evaporator 1 of an evaporation device to be operated as a so-called thin-film dryer. It is essentially composed of a cylindrical tube 2 which in the illustrated embodiment is composed of two tube sections. On their exteriors, the two tube sections 2 are each encased by a spaced casing tube 3 defining a heating chamber 4 into which hot steam is introduced through a respective intake conduit 5, while the developing condensate can be extracted through a discharge conduit 6.

The product to be dried is introduced in pumpable compact or crumbly consistency through a product inlet 7 into the interior 8 of the evaporator. A rotor 9, shown in FIG. 2, which is equipped with vanes 10 that extend continuously over its length and end at a slight distance from the interior wall 11 of the evaporator 1, for example at a distance of about 6 mm, applies the product in an appropriately thin layer to the interior wall 11 and thus conveys it in the direction toward the other end of the evaporator. Depending on the type of product to be treated, the rotor may be provided with vane sections that are set at an angle to the longitudinal axis in the inlet region and/or the outlet region and thus act as conveying vanes.

After passing through about one-fourth to one-third of the overall length, the introduced substance begins to pass through its so-called viscous phase under the influence of the heating medium. In order to improve the evaporation output, the interior of the evaporator may be kept at a pressure slightly below atmospheric in that the resulting vapors are extracted, for example through the product outlet. Upon contact with the heated interior wall 11, larger lumps may form whose outer skin dries quickly while their interior is still wet. Such lumps roll down on the smooth interior wall and thus are either discharged as lumps or are broken up by the rotor vanes, thus forming undesirable fines and dust quantities.

To prevent such lump formation, the interior wall of the evaporator 1, beginning in the region of the so-called viscous phase to near the product outlet 12, is configured as a cutting zone 13. In the illustrated embodiment, the cutting zone is formed by a plurality of linear, web-shaped projections 14 which project into the interior to a height of only a few millimeters. With a free space between the outer edge of the vane 10, on the one hand, and the interior wall 11 of the evaporator 1, on the other hand, of, for example, 6 mm, the height of the projections may be, for example, 3 mm. The projections which are spaced from one another at, for example, 100 mm are arranged, as indicated in the sectional view of FIG. 2, in the wall region in which the vanes perform an upward movement with respect to the direction of rotation of rotor 9 (arrow 15). In this way it is ensured that the lumps lying on the respective top vane surface place themselves against the corresponding edges of the web-shaped projections 14 and thus are retained on the interior wall to be broken up by the edges of vanes 10. At the same time, the now viscous product disposed between the projections is able to move toward the outlet, initially as a layer, then as a stream of granulate.

FIG. 3 is a perspective view of rotor 9 and its vanes 10.

Instead of web-shaped, inwardly projecting projections as shown, the cutting zones may also be formed by corresponding, outwardly oriented, preferably trough-shaped recesses in interior wall 11. If there are such recesses in the wall, larger lumps of a diameter larger than the normal gap between vane edge and interior wall and disposed on the vanes are held back by the edge of the trough-shaped recess so that here again the vane edge is able to break up the lumps.

Depending on the type of product, it may be sufficient if only one trough-shaped recess or one web-shaped projection is disposed as the cutting zone at the interior wall. The cutting zones may here be oriented, as shown, in an axially parallel manner or may be oriented at a small angle, measured relative to the longitudinal axis, in the shape of a helix. Neither for the trough-shaped embodiment nor for the web-shaped embodiment is it necessary that the cutting zones extend over the full length; they may be formed, in a linear arrangement, by dot-shaped recesses or dot-shaped or web-shaped projections of a short length. In the embodiment where they are projections, such projections may be applied, for example, as cams, combs, pins or as weld beads by way of buildup welding. In this connection it is also possible, if a plurality of cutting zones are arranged in parallel, to have a cutting zone in the form of a recess followed in the circumferential direction by a cutting zone in the form of a web-shaped projection.

It will be understood that the above description of the present invention is susceptible to various modifications, changes and adaptations, and the same are intended to be comprehended within the meaning and range of equivalents of the appended claims.

What is claimed is:

1. An evaporation device for drying a sludge, comprising (a) a generally horizontally supported, hollow evaporator tube formed of a cylindrical wall having an inner wall face defining a tube interior of circular cross section; the evaporator tube having an inlet through which the material is introduced into said evaporator tube and an outlet through which material is discharged from said evaporator tube; said inlet and said outlet being disposed in a zone of opposite axial ends of said evaporator tube;

(b) heating means for applying heat to said cylindrical wall externally of said interior for heating the material within the evaporator tube by said inner wall face heated exteriorly;

(c) an externally driven rotor extending longitudinally within said evaporator tube and rotatable relative thereto;

(d) means attached to said rotor for applying material in a layer to said inner wall face; said means comprising a plurality of vanes affixed to said rotor and extending radially therefrom toward said inner wall face; said vanes extending essentially throughout the length of the evaporator tube; and (e) a cutting zone provided on said inner wall face at least in a region of said outlet; said cutting zone extending essentially along said length and cooperating with said vanes for cutting material, caught between said vanes and said cutting zone, as said vanes rotate relative to said cutting zone; said cutting zone interrupting a circular outline of said circular cross section.

2. The evaporation device as defined in claim 1, wherein said cutting zone is composed of a recess provided in said inner wall face.

3. The evaporation device as defined in claim 2, wherein said recess is trough-shaped.

4. The evaporation device as defined in claim 1, wherein said cutting zone is composed of a projection provided on said inner wall face.

5. The evaporation device as defined in claim 4, wherein said projection has an elongated, web-shaped configuration.

6. The evaporation device as defined in claim 5, wherein said projection extends linearly.

7. The evaporation device as defined in claim 1, wherein said cutting zone is provided in a plurality; further wherein the cutting zones are linear, parallel to and circumferentially spaced from one another.

8. The evaporation device as defined in claim 1, wherein said rotor and said vanes have a determined direction of rotation; said cutting zone being disposed in a wall face region being swept by said vanes during upward rotation thereof.

9. The evaporation device as defined in claim 1, wherein a radial height of said cutting zone is a few millimeters.

10. The evaporation device as defined in claim 9, wherein said radial height is 3 mm.

11. The evaporation device as defined in claim 1, wherein a radial clearance between said inner wall face and said vanes is about 6 mm.

* * * * *

UNITED STATES PATENT AND TRADEMARK OFFICE

CERTIFICATE OF CORRECTION

PATENT NO. : 5,375,343

DATED : December 27, 1994

INVENTOR(S) : Josef Egger

It is certified that error appears in the above-indentified patent and that said Letters Patent is hereby corrected as shown below:

On the title page, after item [22] insert the following:

--Related U.S. Application Data

[63] Continuation-in-part of PCT/EP92/01947, Aug. 25, 1992.--.

Signed and Sealed this

Seventh Day of March, 1995

Bruce Lehman

*Attest:*

BRUCE LEHMAN

*Attesting Officer*

*Commissioner of Patents and Trademarks*